US005642809A

United States Patent [19]

Mayville

[11] Patent Number: 5,642,809

[45] Date of Patent: Jul. 1, 1997

[54] GOLD ACCESSORY CASE

[76] Inventor: Michael M. Mayville, 6646 E. Lovers La., Suite 1303, Dallas, Tex. 75214

[21] Appl. No.: 547,382

[22] Filed: Oct. 24, 1995

[51] Int. Cl.[6] ..... B65D 85/18

[52] U.S. Cl. ..... 206/204; 206/278; 206/315.1; 206/579

[58] Field of Search ..... 34/353, 385, 440, 34/441, 444, 209; 206/204, 205, 213.1, 278, 315.1, 579; 223/78

[56] References Cited

U.S. PATENT DOCUMENTS

| | | | |
|---|---|---|---|
| 4,061,170 | 12/1977 | Marks | 150/52 R |
| 4,209,913 | 7/1980 | Wallin et al. | 34/21 |
| 4,565,287 | 1/1986 | Rede et al. | 206/278 |
| 4,958,729 | 9/1990 | Wright | 206/278 |
| 5,177,881 | 1/1993 | Moore | 34/239 |
| 5,186,373 | 2/1993 | Taylor | 224/183 |
| 5,199,573 | 4/1993 | Gribovsky | 206/579 |
| 5,228,547 | 7/1993 | Yoo | 206/315.1 |
| 5,269,410 | 12/1993 | Abregano | 206/315.5 |

*Primary Examiner*—Jimmy G. Foster
*Attorney, Agent, or Firm*—John F. Bryan

[57] ABSTRACT

A foldable case is provided for golf gloves and other accessories wherein a pair of gloves, possibly in a damp condition, are interleaved between absorbent surfaces, without exposure to the open air, so as to be dried without risk of over-drying and the stiffening. The absorbent element placed between the gloves may comprise two layers of absorbent material, joined together along the edges to provide a storage pouch for small items.

9 Claims, 2 Drawing Sheets

GOLD ACCESSORY CASE

FIELD OF THE INVENTION

The present invention relates to containers for holding and organizing golfing accessories and most particularly to such containers which are made to hold golf gloves.

BACKGROUND AND SUMMARY OF THE INVENTION

The nature of golf is such that, the equipment and accessories used during play are not needed at other times. Moreover, those every day essential valuables such as wallet, key ring and wrist watch, become something akin to excess baggage on the golf course. These circumstances are usually addressed by interim storage in the golf bag pouch, satisfactorily in some respects and less so in others.

Golf gloves are often damp with perspiration when the game is over and become crumpled and misshapen if left in the bag. Repeated air drying leaches out the natural oils, eventually making the leather hard and brittle, like rawhide.

Finding a tee can be an exercise in patience, while groping around the bottom of the pouch, amongst the balls and miscellany. Loose change or a wrist watch, either of which can be distracting to a player, add to the clutter of tees, score cards and other small accessory items, if stored in the golf bag. A player may resort to carrying a drawstring "tote-bag" but, for the lack of a better solution, most simply learn to accept the inconveniences and tolerate the distractions.

An object of the present invention therefore, is to provide for less severe drying of golf gloves, so as to maintain and condition them for a longer useful life. A second object is to provide a device for storage of personal items in a compact, convenient form and yet another object is to reduce golf bag clutter by providing separate means for storing the smaller golf accessory items.

The present invention achieves these objectives with a storage case, which can be fastened shut and folds along a central hinged length to open in book-like fashion. A pair of golf gloves are flattened to lie against the inner surface of each side of the case where they are held by a piece of VELCRO™ positioned to meet the wrist strap attachment patch of the glove. An absorbent flap, preferably of leather, is attached to the case along its hinged length and lies against the gloves to remove excess moisture. In a preferred embodiment of the invention, the absorbent flap comprises two layers, one for each glove, which are joined to form an internal pouch.

DESCRIPTION OF THE DRAWINGS

The aforementioned and other objects and features of the invention will be apparent from the following detailed description of specific embodiments thereof, when read in conjunction with the accompanying drawings, in which.

DETAILED DESCRIPTION OF THE DRAWINGS

Figure 1:
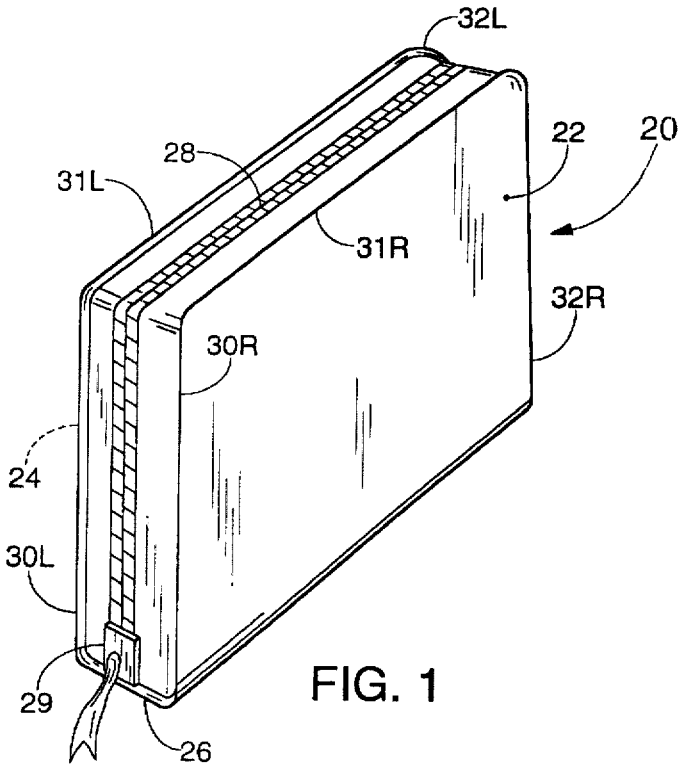
FIG. 1. shows a preferred embodiment of the present invention as it appears when closed.

In FIG. 1, storage case 20 of the present invention is shown to include opposed outer faces 22 and 24 of similar size and shape, made as hinged halves so as to fold along a common lengthwise portion 26. When faces 22 and 24 are folded together, as shown in FIG. 1, zipper slide 29 fastens zipper 28 around the open sides 30L&R, 31L&R and 32L&R. Thus, storage case 20 is closed so that it can be safely and conveniently carried or stored.

Figure 2:
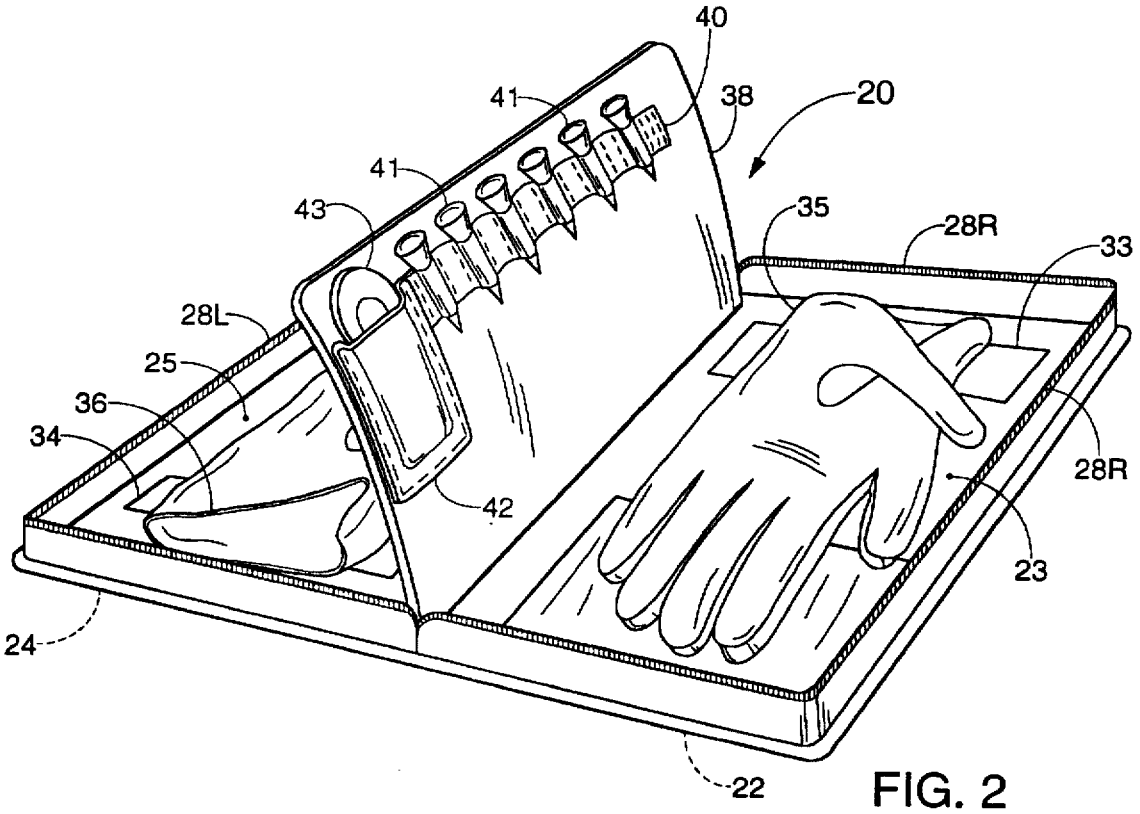
FIG. 2 shows the embodiment of FIG. 1 as it appears when opened.

FIG. 2 shows an interior arrangement of storage case 20 as it appears when zipper 28 is unfastened to open storage case 20 so that outer faces 22 and 24 are co-planar, as when laid on a common surface. Although zipper 28 is shown in this preferred embodiment, other forms of attachment such as snaps, catches, latches or the hook and loop type fabric fastener, known and marketed as VELCRO™. Golf gloves, as made today, all but universally include VELCRO™ for adjustable wrist strap attachment patches. VELCRO™ pieces 33 and 34 are positioned on inner faces 23 and 25 so as to retain golf gloves 35 and 36, in the flattened condition shown, by engaging its wrist strap attachment patch. Centrally located, absorbent flap 38, preferably a relatively heavy piece of soft, unfinished leather such as pigskin, is attached along the inside of lengthwise portion 26. Flap 38 is sized to cover the length and width of the flattened gloves 35 and 36 when storage case 20 is closed. Inner faces 23 and 25 comprise a similar material so that gloves 35 & 36 are pressed between absorbent layers when storage case 20 is closed and moisture is removed in the absence of ventilation without over-drying. Unfinished leather is the preferred material for lining inner faces 23 & 25 and for flap 38 because of its breathable, absorbent nature and for its natural oil content which helps to maintain and condition the glove leather for softness and flexibility.

Pockets 40 and 42, also of absorbent material and preferably leather, are attached to flap 38 to retain tees 41 and greens repair tool 43. Placement of the accessories and the material of pockets 40 and 42 maintain the functional absorbency of flap 38.

Figure 3:
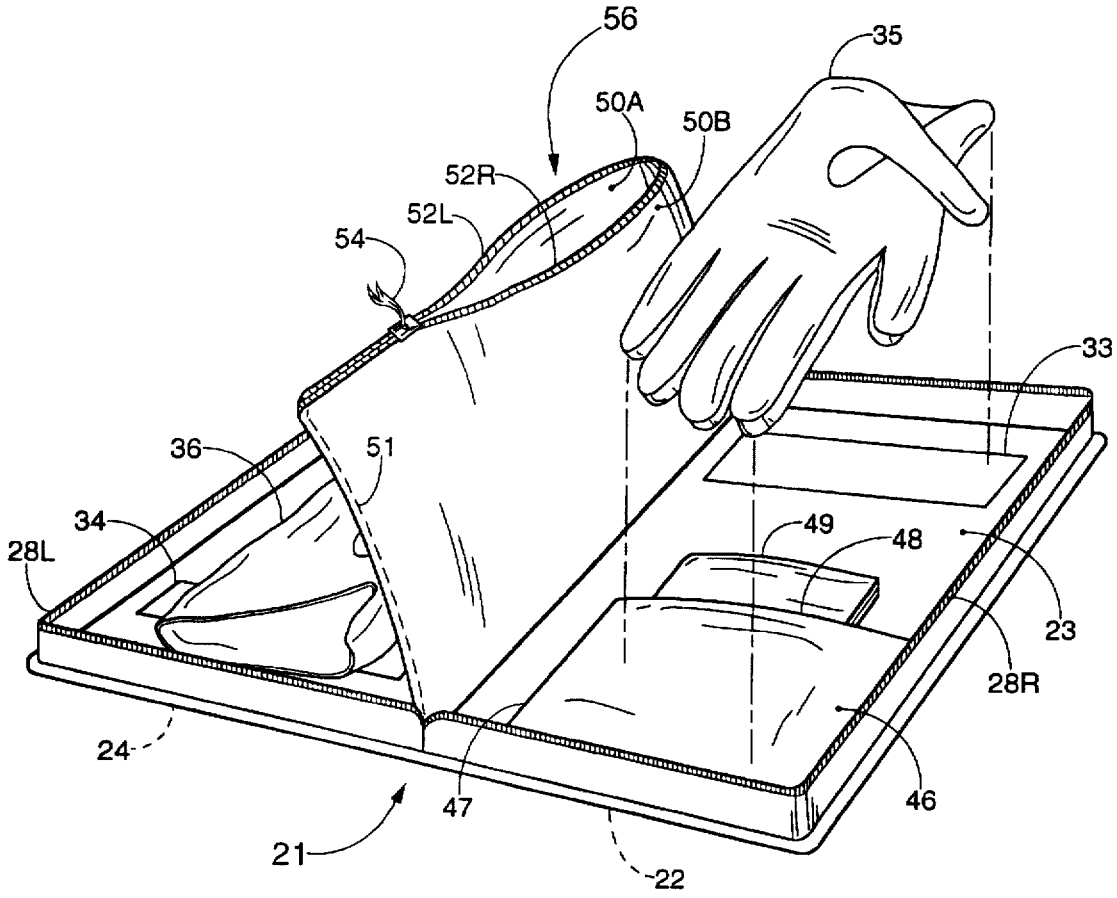
FIG. 3 shows an alternate interior configuration of the preferred embodiment of FIG. 1.

FIG. 3 shows storage case 21 having an alternate arrangement of the interior elements. Outer faces 22 and 24, inner faces 23 and 25, VELCRO™ pieces 33 and 34, zipper 28 and gloves 35 and 36 are as previously described. Rectangular corner flap 46, again, of absorbent material and preferably leather, is attached to inner surface 23 along two adjacent edges and open along edges 47 and 48 so as to store score cards 49 for reference. Centrally located, absorbent flap 38 is replaced with flaps 50A and 50B of similar material, joined at the edges by stitches 51 and by zipper 52R&L to form separate pouch 65. Pouch 65 is opened and closed by zipper slide 54, for storage of valuables or miscellaneous items. Thus, flaps 50A and 50B have dual utility, functioning both to condition gloves and to provide separate storage means.

It is to be understood that the present invention is not limited to the embodiments disclosed but may also be expressed in other embodiments within the spirit of the invention, through rearrangement, modification or substitution of parts.

I claim:

1. A golf glove conditioning container comprising:

first and second opposed panels of like dimensions, said panels having outer surfaces and absorbent inner surfaces;

means flexibly joining said opposed panels along a common boundary, so that said panels may be opened apart or closed together with facing inner surfaces to provide an enclosed interior space;

means for retaining a golf glove against each said inner surface; and a third absorbent panel centrally positioned between, and sized to cover, said gloves so that each glove is pressed between two absorbent surfaces in an unventilated enclosure.

2. A golf glove conditioning container according to claim 1 wherein said third absorbent panel is a leather flap.

3. A golf glove conditioning container according to claim 1 wherein said third absorbent panel comprises a pair of flaps of similar size and shape.

4. A golf glove conditioning container according to claim 1 wherein said third absorbent panel further comprises means for storing accessory items.

5. A golf glove conditioning container according to claim 1 wherein said third absorbent panel further comprises:

a pair of flaps of similar size and shape; and means for joining the periphery of said flaps so as to contain accessory items.

6. A golf glove conditioning container according to claim 1 wherein said third absorbent panel comprises;

a leather flap; and means for retaining accessory items.

7. A golf glove conditioning container according to claim 1 wherein said glove retaining means comprises hook and loop fabric fasteners.

8. A golf glove conditioning container according to claim 4 wherein said third absorbent panel comprises;

a leather flap; and means attached to said flap for retaining accessory items.

9. A method for storing and conditioning golf gloves comprising the steps of:

providing a pair of flexibly connected panels having absorbent inner surfaces which fold from facing to coplanar positions;

flattening a golf glove a against each facing inner surface;

interposing a flap having absorbent surfaces between the flattened gloves, the flap dimensions being substantially equal to or greater than the dimensions of the flattened gloves;

providing a fastener to selectively hold the facing panels together so as to form an unventilated enclosure; and holding each glove tightly between the absorbent surfaces.

* * * * *

UNITED STATES PATENT AND TRADEMARK OFFICE

CERTIFICATE OF CORRECTION

PATENT NO. : 5,642,809
DATED : July 1, 1997
INVENTOR(S) : Michael M. Mayville

It is certified that error appears in the above-indentified patent and that said Letters Patent is hereby corrected as shown below:

On title page, item [54] and col. 1, line 1, "GOLD" should read --GOLF--

Signed and Sealed this

Twenty-third Day of September, 1997

*Attest:*

*Attesting Officer*

BRUCE LEHMAN

*Commissioner of Patents and Trademarks*